US005643531A

United States Patent [19]

Kim et al.

[11] Patent Number: 5,643,531

[45] Date of Patent: Jul. 1, 1997

[54] FERROUS ALLOY COMPOSITION AND MANUFACTURE AND COATING METHODS OF MECHANICAL PRODUCTS USING THE SAME

[75] Inventors: Kang-Hyung Kim; Maeng-Roh Park, both of Kyung Nam; Seung-Ho Yang, Seoul; Yong-Kwon Chi, Kyung Nam, all of Rep. of Korea

[73] Assignee: Samsung Heavy Industry Co., Ltd., Rep. of Korea

[21] Appl. No.: 340,772

[22] Filed: Nov. 16, 1994

[30] Foreign Application Priority Data

| | | | |
|---|---|---|---|
| Dec. 12, 1989 | [KR] | Rep. of Korea | 1993-30179 |
| Dec. 28, 1993 | [KR] | Rep. of Korea | 1993-30180 |
| Dec. 28, 1993 | [KR] | Rep. of Korea | 1993-30181 |
| Dec. 28, 1993 | [KR] | Rep. of Korea | 1993-30183 |

[51] Int. Cl.[6] ..... C22C 38/32; B32B 15/18

[52] U.S. Cl. ..... 420/64; 420/583; 148/326; 148/403; 427/405; 427/383.1; 427/123; 75/302

[58] Field of Search ..... 420/64, 583; 148/326, 148/403; 427/405, 383.1, 123; 75/302

[56] References Cited

U.S. PATENT DOCUMENTS

| | | | |
|---|---|---|---|
| 3,382,065 | 5/1968 | Oberle et al. | 420/64 |
| 4,810,464 | 3/1989 | Szerto et al. | 420/97 |
| 4,822,415 | 4/1989 | Dorfman | 75/251 |

FOREIGN PATENT DOCUMENTS

| | | | |
|---|---|---|---|
| 12352 | 9/1981 | Japan | 420/583 |
| 213640 | 6/1970 | U.S.S.R. | 420/64 |
| 469563 | 5/1975 | U.S.S.R. | 420/64 |

*Primary Examiner*—Deborah Yee
*Attorney, Agent, or Firm*—Lieberman & Nowak, LLP

[57] ABSTRACT

Disclosed is a manufacture and coating method of mechanical products using ferrous alloy in order to improve wear, corrosion, and heat resistances of the mechanical products which are exposed to friction and wear environments with or without lubricating conditions. The mechanical products of the invention include rotation contact parts such as bush and shaft in the inside of caterpillar roller, mechanical seal under high surface pressure, and drawing dice and plug under sliding friction stress. A ferrous alloy composition used for coating in the invention comprises Cr:18.0–42.0 wt %, Mn: 1.0–3.2 wt %, B:3.0–4.5 wt %, Si: 1.0–3.0 wt %, C: less than 0.3 wt %, inevitably incorporated impurities, and Fe for the rest of content. A ferrous alloy composition used for manufacturing bush type product comprises C: less than 4.5%, Si:2.5%, Mn:less than 2%, Cr:0.5–35%, and Fe for the rest of content. The mechanical products prepared by the material of the invention exhibits increased durability and can be used at the place of the expensive conventional mechanical products.

14 Claims, 13 Drawing Sheets

| | FRICTION TORQUE Ksf.-m | LIFETIME | TEST CONDITION |
|---|---|---|---|
| CARBURIZATION BUSH MATERIAL | 100 | 1.9 Hr | * SURFACE PRESSURE LOAD : 4 Kgf/MM$^2$<br>* SLIDING SPEED : 136 CM/MIN<br>* GREASE |
| NO. 1 | 30 | OVER 480 Hr | |

TEST CONDITION
SURFACE PRESSURE LOAD: 0Kgf/mm
SLIDING SPEED: 175mm/sec

FERROUS ALLOY COMPOSITION AND MANUFACTURE AND COATING METHODS OF MECHANICAL PRODUCTS USING THE SAME

BACKGROUND OF THE INVENTION

The present invention is concerned with ferrous alloy composition and manufacture and coating methods of mechanical products using the ferrous alloy in order to improve wear, corrosion, and heat resistances of the mechanical products which are exposed to friction and wear environments with or without lubricating condition.

In order to improve the friction and wear resistances of the mechanical products such as the connection parts interconnecting the main body, boom, arm and bucket with each other, roller, gear and mechanical seal which subject to high surface pressure, there have been employed various techniques on the ferrous material such as carburization, nitridization, high frequency induction hardening, sulfurization, polymer coating with PTFE, electroless Ni plating, and ceramic coating.

However, in terms of the friction and wear characteristics such as mobile friction coefficient, wear amount, and wear depth, the mechanical products made by applying the conventional techniques have not exhibited the satisfactory properties, and the application of new material and manufacture techniques has been required.

For example, although the carburization increases the surface hardness, the high surface pressure acted on the mechanical parts which are subject to high friction condition pushes away the lubricant despite the use of grease lubrication, and decreases considerably the friction and wear resistances of the mechanical products. Accordingly, in case of excavator, there has been a problem that the grease should be often supplied, for instance, one to three times a day. In addition, for undercarriage roller and idler bush, the lubricants have been supplied with sealing but there have been still problems such as short wear lifetime and lubricant leakage.

In order to solve the above problems, the present inventor proposed the use of urethane rubber bushing in the Korean Utility Model Appln. No. 92-6031. However, although urethane rubber bushing improves the friction characteristics, its use has been restricted due to the durability problem for the parts which are subject to high surface pressure. Furthermore, the surface coating on the steel matrix using $Al_2O_3$, WC, and $Cr_3O_2$, etc., to increase the surface hardness exhibits a poor shock resistance due to the difference in physical property between matrix and coating layer, but also causes the problem of poor durability with time since the thermally transformed matrix phase formed during coating process deteriorates the mechanical properties. In fact, for the mechanical parts such as drawing die and plug which are subject to high shear sliding stress, the surfaces coated as above cannot endure the mechanical stress for long time and readily wear out, causing the problem of frequent replacement of the mechanical parts. For these reasons, the expensive die steel or WC sintered dice material have been used, but their uses have been restricted due to the wearability and expensive manufacture cost.

On the other hand, since it was disclosed by Duwez, et al in 1960 that the amorphous materials can be formed by rapidly cooling the metal melt and exhibit the improved mechanical properties compared to the crystalline materials in terms of strength, corrosion resistance, etc., the application of amorphous materials to the mechanical products has been the subject of many research works. However, In order to obtain the amorphous phase, the melt should be supercooled by 10° C./see or over, which makes the processing more difficult.

SUMMARY OF THE INVENTION

It is an object of the present invention to provide a ferrous alloy for coating material having similar principal composition element to Fe, the steel matrix.

It is further an object of the present invention to provide a coating method using said ferrous alloy which consists of forming the coating layer of unstable structure on the surface of the mechanical product by thermal spraying, welding or plasma coating, and transforming the coating layer to amorphous structure with high hardness by the mechanical stress due to friction and wear.

It is further an object of the present invention to provide various mechanical products coated with said ferrous alloy.

It is still further an object of the present invention to provide a ferrous alloy which can be used for the manufacture of mechanical products such as bush that is used in the parts subject to high surface pressure and require high wear resistance and durability.

DETAILED DESCRIPTION OF THE INVENTION

Figure 1:
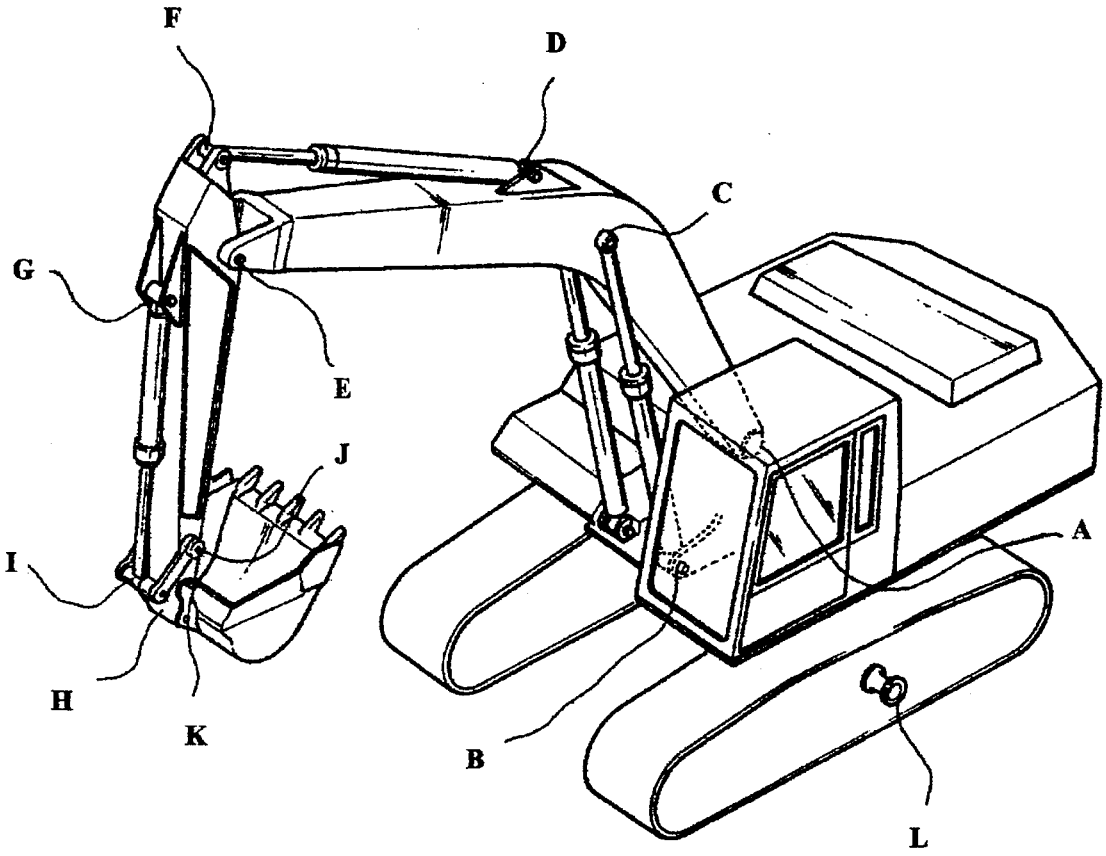
FIG. 1 shows mechanical parts of work implements coated with ferrous alloy according to the present invention.

A coating material used in the present invention comprises iron as the principal composition element, Cr: 18.0–42.0 wt %, Mn: 1.0–3.2 wt %, B: 3.0–4.5 wt %, St: 1.0–3.0 wt %, and C: less than 0.3 wt % by weight percent. When necessary, said composition further comprises P less than 0.5 wt %, or Ge and/or As less than 1.0 wt %. In addition, the wear resistant second phase materials, WC and/or TiC can be added to said composition when it is necessary. Furthermore, among Mo, Zr, Co and Ni, one or more elements can be comprised in the range of 0.5–1.0 wt %.

The reason for limiting the amount of alloy elements as above is as follows.

Cr is an effective element for high corrosion resistance and strength, and limited to 18.0–42.0 wt %, since Cr less than 18.0 wt % makes it difficult to form the amorphous structure and Cr more than 42.0 wt % induces the precipitation of δ phase which hampers the amorphous formation in solid solution.

Mn remains in the α solid solution in the range of 1.0–3.2 wt %, above which the amorphous formation becomes difficult.

B contributes greatly to the amorphous formation of Fe—Cr—Mn and strengthens the amorphous structure, which is appreciable with more than 3 wt %. However, B more than 4.5 wt % forms the compound precipitate exhibiting brittleness and it is limited to less than 4.5 wt %.

Si is necessarily incorporated for the amorphous formation. With Si less than 1.0 wt %, the amorphous formation does not occur sufficiently, and with more than 3.0 wt %, it forms the brittle compound with Fe.

C is an element to increase the strength, but exhibits the brittleness with more than 0.3 wt %.

P remains necessarily as a result of iron making and contributes to the amorphous formation. However, with more than 0.5 wt %, it forms $Fe_3P$ and exhibits brittleness. P, Ge and As also contribute to the formation of an amorphous structure. However, studies have shown that Ge and As when present in an amount greater than 1.0 wt % tend to form high melting point intermetallic compounds which interfere with amorphourization.

In the following, the coating method of said ferrous alloy on the surface of the mechanical product will be described in detail.

Said alloy is made into powder with a density of 7.3–7.4 g/cc, or wire form, etc., and then coated onto the steel matrix by thermal spraying, welding, etc. The thermal spraying can be achieved by using jet gun, flame, arc, HVOF (high velocity oxyfuel), plasma, laser, etc., depending on the shape to be sprayed, and all the methods are included in the scope of the present invention. During the spraying, the melt temperature is about 2500°–200000° C., and it solidificates right after being sprayed onto the surface to be coated, forming the homogeneous single phase supersaturated solid solution.

The coating layer formed as described in the above has the unstable structure which can be transformed into the stable amorphous structure with high hardness and toughness under the friction and wear environments as the ordered structure is destroyed by the mechanical stresses. The thickness of transformed layer is about 2.0 to 16.0 μm and its surface hardness is above HRc 70. In addition, although the surface wears out due to the continuous use, the abrupt wearing does not occur since the surface is continuously hardened as the newly exposed surface layer is transformed again into the amorphous structure by the friction stress. Furthermore, since there are no grain boundaries exposed to the exterior, the breaking off of the surface atoms is greatly reduced due to the homogeneous activation energies of the surface atoms, resulting in the improvement of adhesive wear resistance property. On the other hand, the non-existence of grain boundaries and high Cr content of said amorphous phase contribute to high corrosion resistance as well as high heat resistance above 800° C. due to the high resistance against high temperature grain boundary oxidation, etc. In addition, since the thermal expansion coefficient of ferrous coating material is fairly same as that of the steel matrix to be coated, it is little affected by the thermal shock after coating process.

The ferrous alloy materials of the present invention can be coated onto the slide friction parts(A–L) or contact areas of gears in the heavy caterpillar roller and work implement as shown in FIG. 1, mechanical seal subject to high surface pressure load where rubbery products cannot be employed, and steel tube drawing dice and plug which are subject to high sliding stress, etc. The mechanical products as surface coated as above can replace the expensive conventional products, but also exhibit the appreciably improved durability.

Another feature of the present invention is to provide ferrous alloy with good friction and wear resistance properties, which comprises by weight percent, C: less than 4.5 wt %, St: less than 2.5 wt %, Mn: less than 2 wt %, Cr: 0.5-35 wt %, and Fe for the rest of content. When necessary, said composition can further comprise one or more elements of Ni, Mo, and B by less than 5 wt %. In the following, the reason for limiting the composition will be explained.

C and Mn are the elements that are necessarily required in order to increase the strength and hardness of the material. Particularly, C can be decreased depending on the amount of Si and Mn, but is limited to less than 4.5 wt % which is the maximum allowable amount for the casting products. Mn can be comprised up to 2 wt % with the decrease in C, but it causes no meaningful effects above 2 wt %. Si exhibits similar effects to those of C, but is limited to less than 2.5 wt % since the excessive amount makes no effect. Cr is the very important element of the present invention for high hardness, low friction coefficient, and high corrosion and heat resistances and added up to 35 wt % above which it is unnecessary. However, Cr should be added by at least 0.5 wt % to effect the required properties. Furthermore, Ni, Mo, B can be added by less than 5 wt % to improve further the hardness, and friction and wear resistances.

In the following, the characteristics of the present invention will be described in more detail with reference to examples.

EXAMPLE 1

Figure 2:
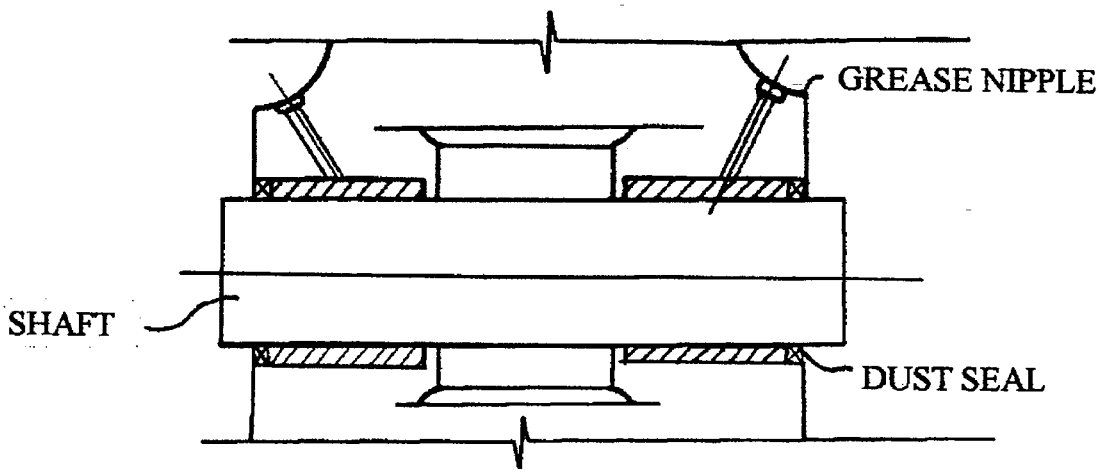
FIG. 2 shows a bush used for work implements of heavy equipment.

The interior surface of the bush (5) in FIG. 2 was pre-treated using sand blast, and then said ferrous alloy was coated on the surface by the thickness of 0.1–5 mm using thermal spraying. Before amorphous transformation, the surface hardness was HRc 55–60.

Figure 3:
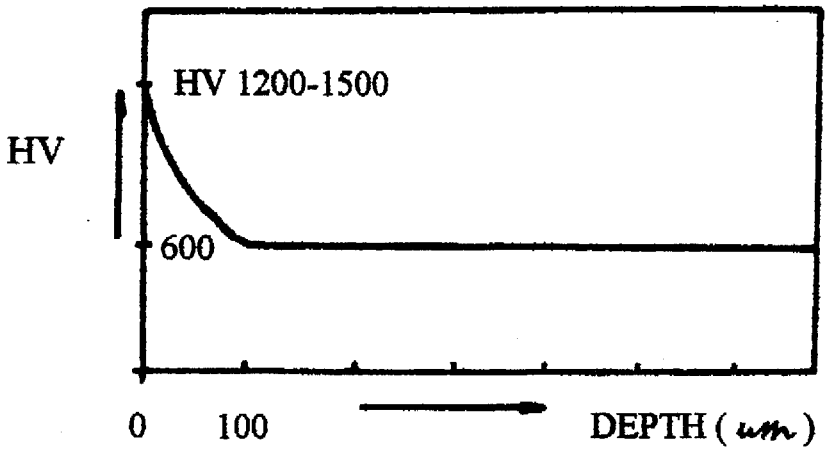
FIG. 3 is a graph showing the transformation induced hardening depth of the surface layer.

The surface of specimen coated as above was transformed into the amorphous phase due to a friction stress under the friction environment and exhibited the surface hardness of HRc 70. The transformation induced hardening depth of the surface layer was about 100 μm as shown in FIG. 3.

EXAMPLE 2

Figure 4:
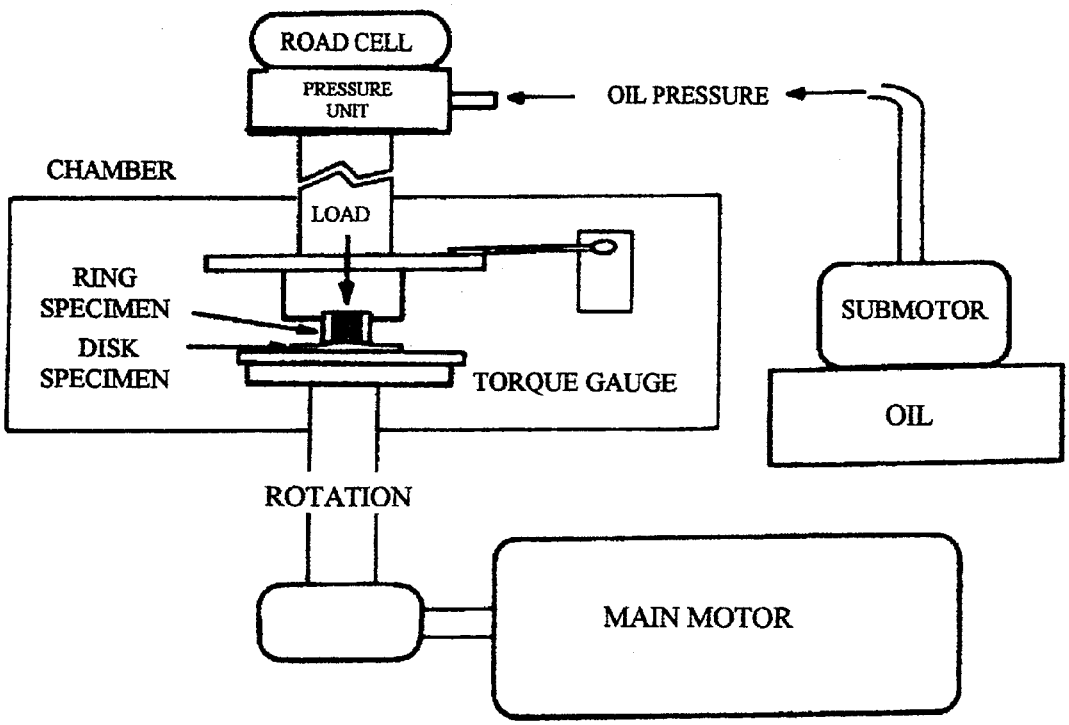
FIG. 4 is a schematic view showing the experimental equipment for performing ring on disk test.
Figure 5:
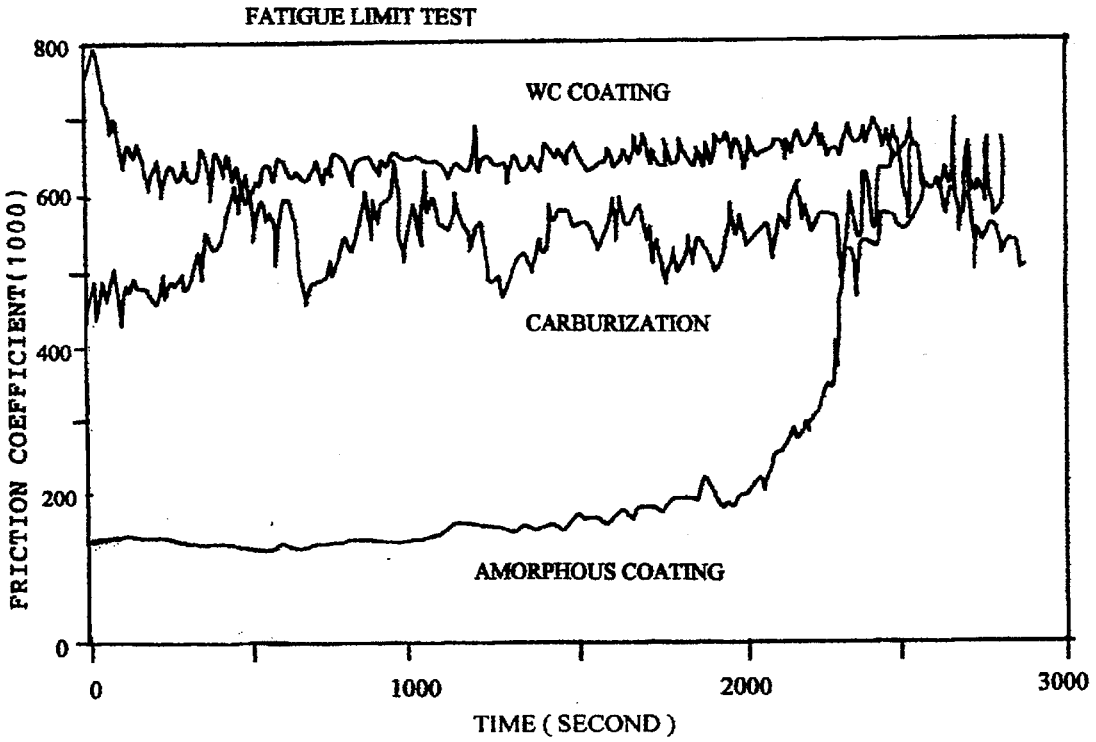
FIG. 5 is a graph showing the result of test in example 2.

Ring on disk test was performed in the experimental equipment as shown in FIG. 4 without lubricant under the conditions of room temperature, 36 rpm, and 500 kgf, and its result is shown in FIG. 5. As can be seen in FIG. 5, the amorphous specimen exhibited very low friction coefficients(0.09–0.14) compared to those of other specimens. Generally, the carburized bush and the WC coated bush specimens exhibited very high friction coefficients of 0.45–0.65 from the initial period of test, and even in 1000 sec, the considerable amount of wear occurred with weared particles was readily detected. However, the friction coefficient of amorphous coated specimen increased to the level equivalent to that of other specimen in about 2200 sec with no weared particles detected. After 2200 sec, only friction coefficient increased.

Accordingly, it could be seen that if the amorphous ferrous alloy material is coated onto the friction and wear parts and used with lubrication, the mechanical parts can be used for sufficiently long time. Particularly, those mechanical parts can be used without lubrication, lowering the manufacturing cost by eliminating the lubrication related processes as well as increasing the maintenance efficiency by increasing the period of supplying the lubricant oil even in the case that the lubrication is inevitably required. In addition, the low friction coefficient of the amorphous phase greatly reduces the operation noise sound of the friction part, resulting in the improvement of the working environment.

EXAMPLE 3

Figure 6:
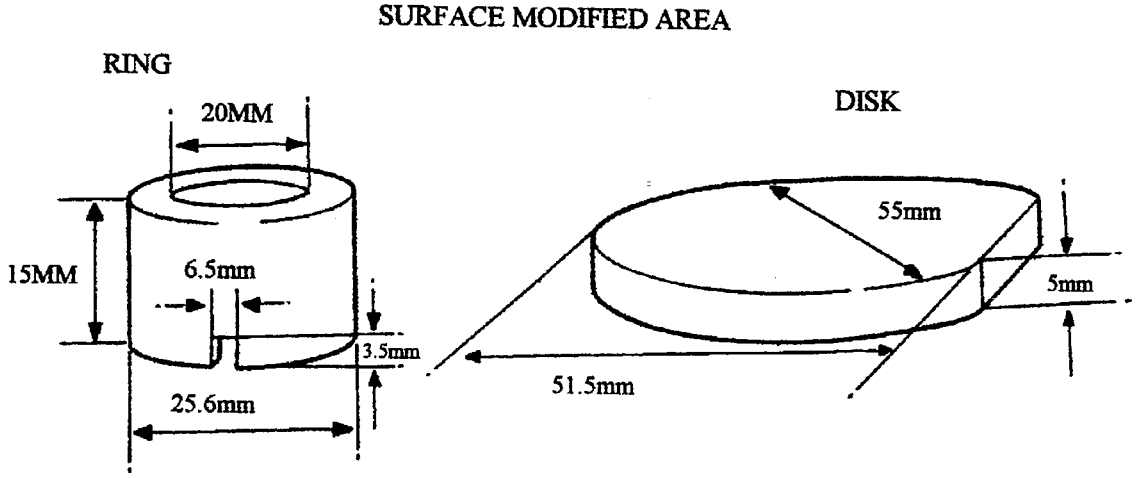
FIG. 6 is a schematic view showing the disk specimen.
Figure 7:
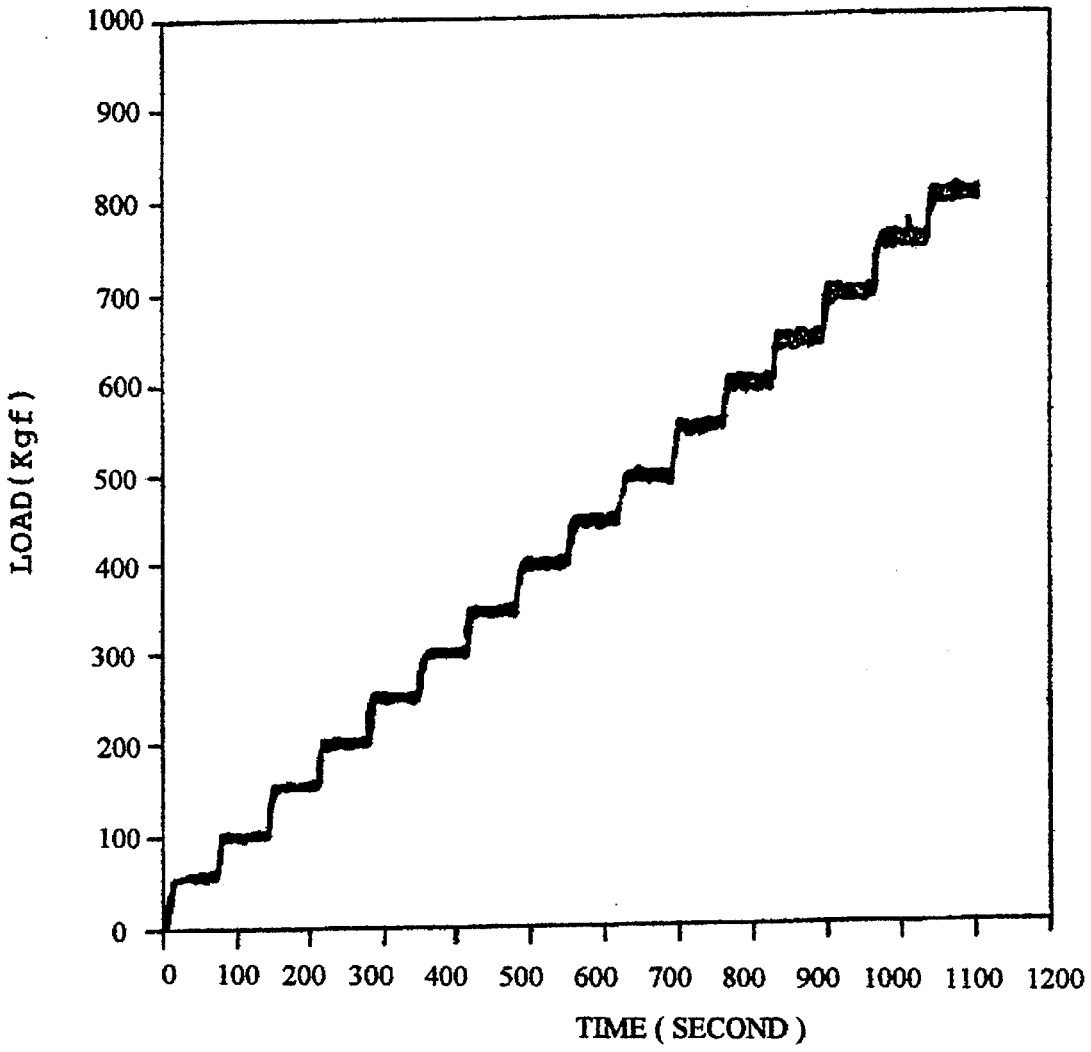
FIG. 7 is a graph showing the experimental condition in example 3.

The powdery ferrous alloy comprising Si:1.7 wt %. Cr:22.4 wt %, Mn:2.3 wt %, B:3.7 wt %, C:0.12 wt %, and Fe for the rest of content was rolled into the wire form using a thin metal foil, and the wire feeding thermal spray was performed on the disk specimen of the FIG. 6. Using these specimens, ring on disk test was performed by the experimental equipment as shown in FIG. 4 under the conditions shown in FIG. 7. The ring specimen for the test was made as shown in FIG. 6 using high frequency induction hardened SM 45C so that the hardness of friction contact area is Hv 500–570.

| | Preparation of Specimen | | Dynamic Friction | |
|---|---|---|---|---|
| No. | Ring | Disk | Coefficient | |
| 1 | Induction Hardening | Induction Hardening | 0.72 | Comparative Example |
| 2 | Induction Hardening | Amorphous Coating (Spray) | 0.12 | P. I. |
| 3 | Induction Hardening | PIFE Coating | 0.07 | P. I. |
| 4 | Induction Hardening | Copper Alloy + Graphite Insert | 0.1–0.23 | P. I. |

*P.I. means the Present Invention.

Figure 8:
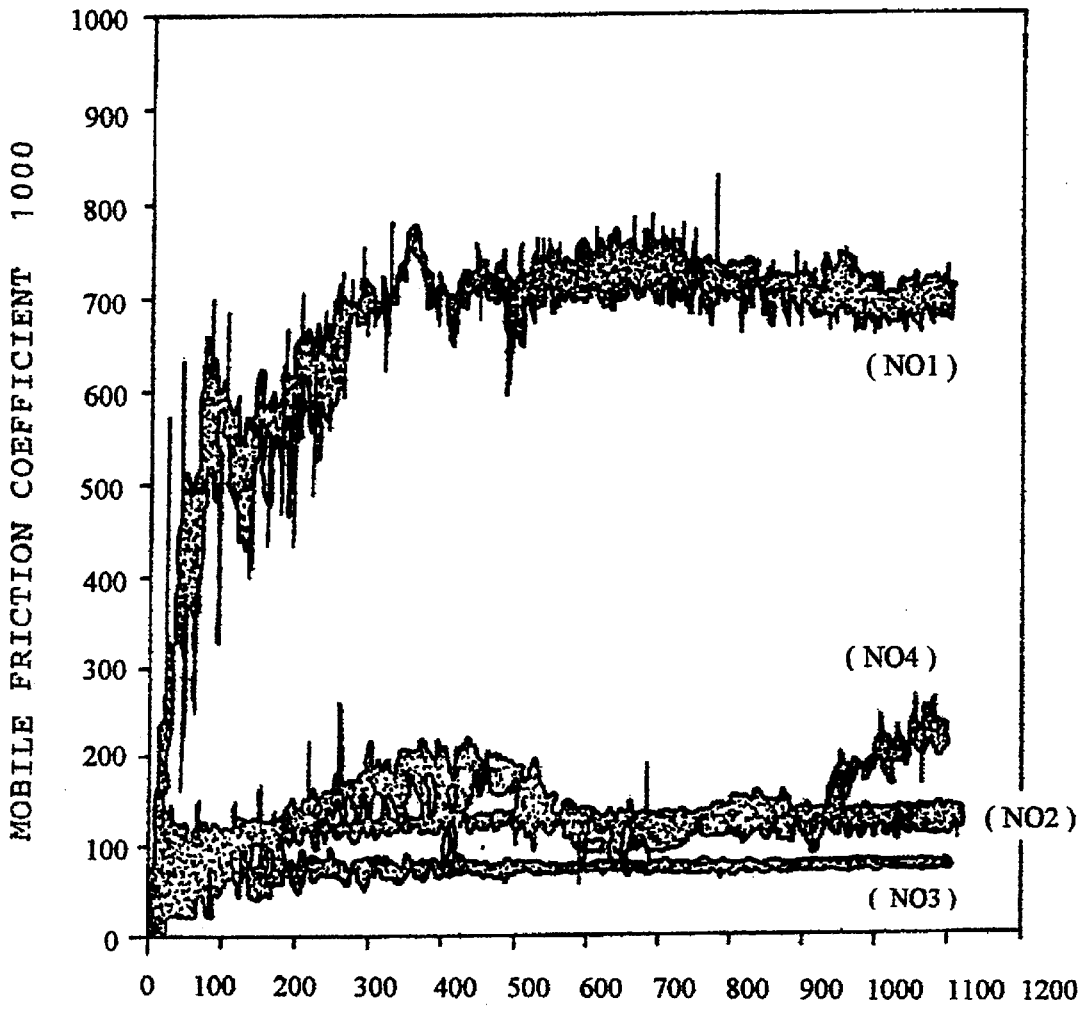
FIG. 8 is a graph showing the result of test in example 3.
Figure 9:
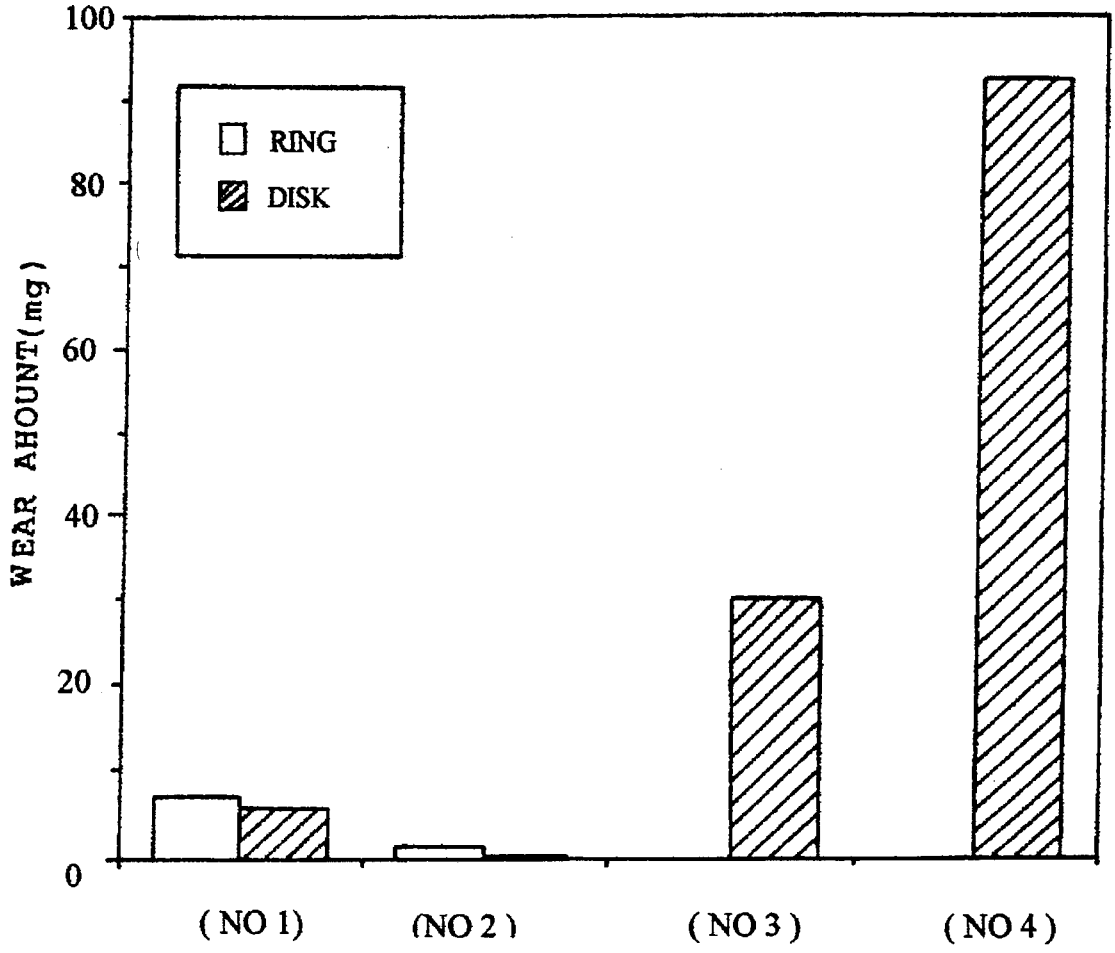
FIG. 9 is a graph showing wear amount in example 3.
Figure 10:
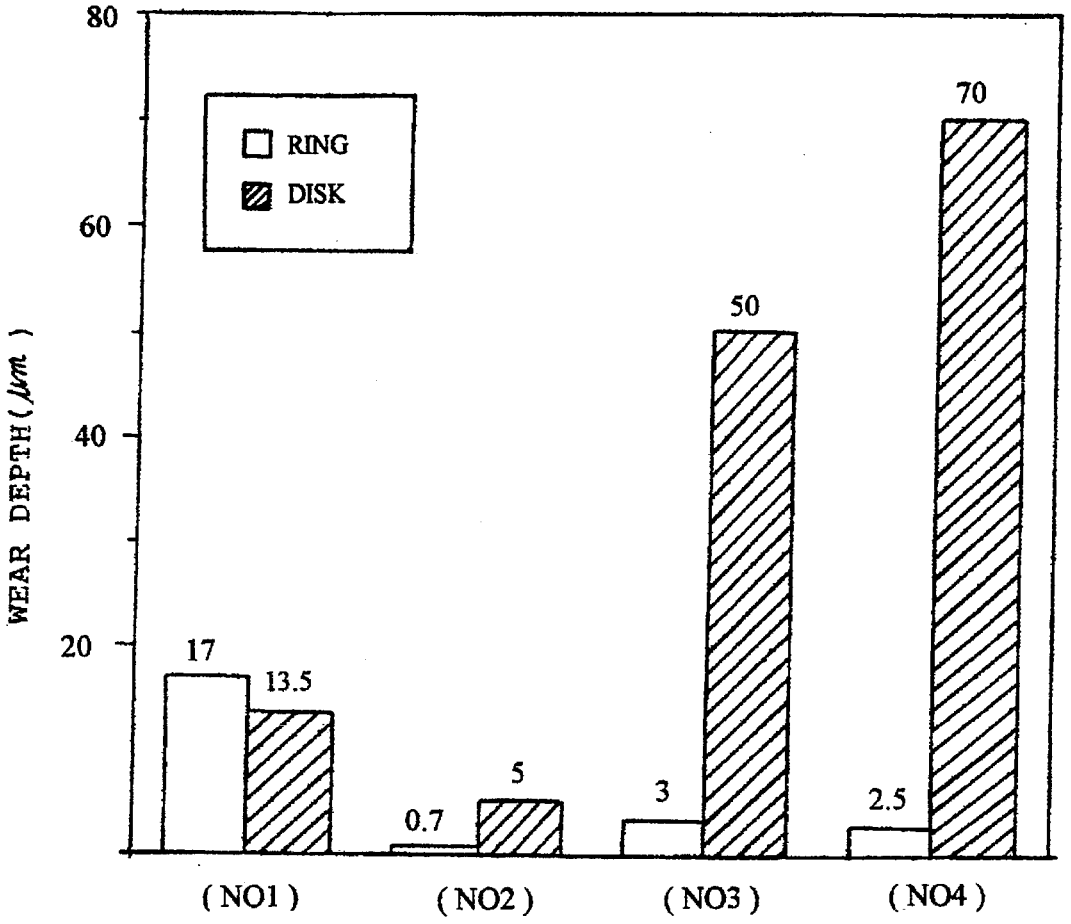
FIG. 10 is a graph showing wear depth in example 3.

As shown in table 1, the comparative disk specimens used were SM 45C materials which were high frequency induction hardened, PTFE coated or coated with Cu alloy and graphite carbon. The result is shown in FIG. 8. No. 1 specimen showed the considerable degree of wear in the initial period of test. No. 4 specimen also showed the unstable wear pattern. No. 2 and No. 3 specimen showed the low and stable mobile friction coefficients. Also, as can be seen in FIG. 9 and FIG. 10, No 2 specimen made by the technique of the present invention exhibited the improved characteristics in terms of the wear amount and wear depth. In case of No. 3 specimen, the friction coefficient was relatively low, but the wear proceeded rapidly with the increase of load. This indicates that the amorphous coating material is not only more resistant to the high surface pressure but exhibits lower friction coefficients than the other ferrous alloy material, non-ferrous, or non-metallic materials.

Accordingly, it was confirmed that the use of ferrous alloy of the present invention for the coating material leads to the increased material life and the Improved mechanical properties, and it is expected that said material coating can exhibit better properties compared to WC or ceramic coating. When the coating method of the present invention is applied to the commercial products, the various processes such as spraying and welding can be used for the ring type or plate type, and the welding is preferred for the mechanical products which are subject to mechanical shock.

EXAMPLE 4

The powdery ferrous alloy comprising Si:1.8 wt %. Cr:26.5 wt %, Mn:1.26 wt %, B:3.2 wt %, P:0.02 wt %, C:0.08 wt %, and Fe for the rest of content was rolled into the wire form using a thin metal foil, and the wire feeding thermal spray was performed on the disk specimen made of SM45C KS material. The particle size distribution was in the range of 10–30 μm. Using these specimens, ring on disk test was performed in the experimental equipment as shown in FIG. 4. The ring specimen for the test was made using high frequency induction hardened SM 45C KS so that the hardness of friction contact area is Hv 500–570.

Figure 11:
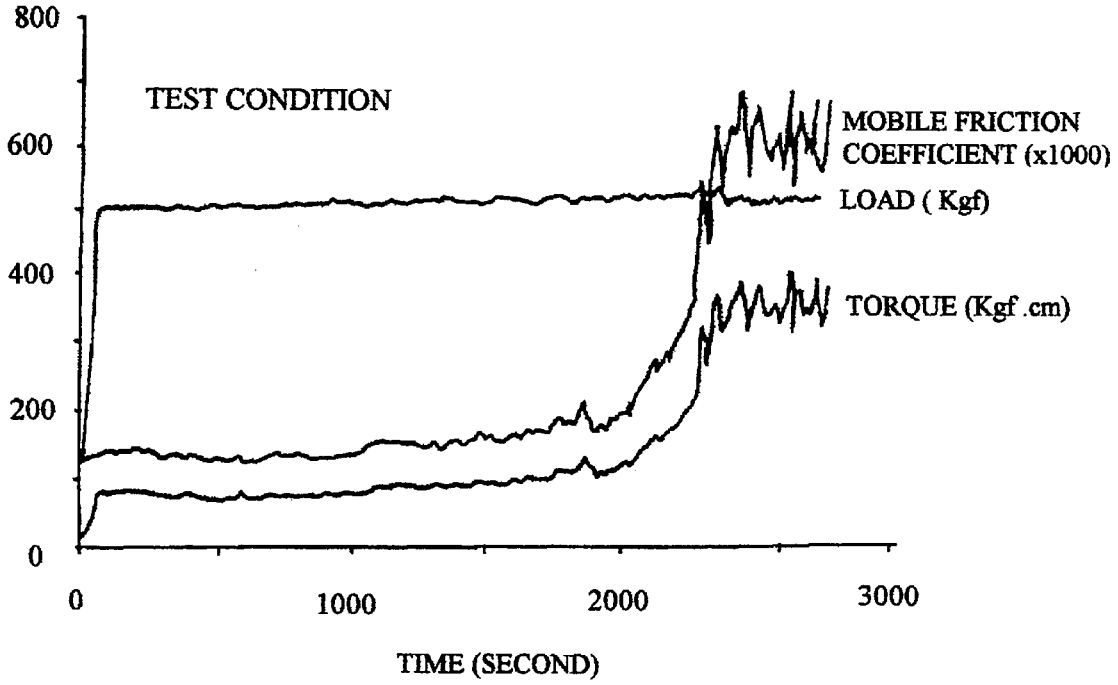
FIG. 11 shows the result of endurance limit test in example 4.

As can be seen in FIG. 11, the specimen prepared according to the present Invention exhibited the stable mobile friction coefficients for the considerable amount of time even without lubrication. On the other hand, when the coating material of the present invention was thermally sprayed onto the drawing dice made of WC sintered alloy, the surface hardness was HRc 50–52 after spraying, but the hardness Increased to above Hv 1200 after finish polishing, and exhibited the maximum hardness of Hv 1300to 1500 at the most surface friction wear. The thickness of amorphous coating layer was 0.15 min. For the coating thickness less than 20 μm, it could not be used under the high loading conditions such as cold drawing, and for the thickness more than 5 mm, no improvement was observed.

EXAMPLE 5

The material with the chemical composition and hardness as shown in table 2 was prepared, and friction and wear test was performed.

| | O | Si | Mn | P | S | Ni | Cr | Mo | B | Hardness | |
|---|---|---|---|---|---|---|---|---|---|---|---|
| No.1 | 0.08 | 1.8 | 1.26 | — | — | — | 28.5 | — | 3.20 | HRC 55 | P.I. |
| No.2 | 1.91 | 0.52 | 0.50 | 0.13 | 0.018 | 0.17 | 20.8 | 0.35 | — | HRC 45 | P.I. |
| No.3 | 1.91 | 0.28 | 0.29 | 0.016 | 0.010 | 0.23 | 4.16 | 0.15 | — | HRC 65 | P.I. |
| No.4 | 0.45 | 0.25 | 0.70 | 0.015 | 0.015 | 0.05 | 0.05 | — | — | HB 190 | Comparative Example |
| No.5 | 0.20 | 0.25 | 0.45 | 0.015 | 0.015 | — | — | — | — | HRB 60 | Comparative Example |

*P.I. means the Present Invention.

Figure 12:
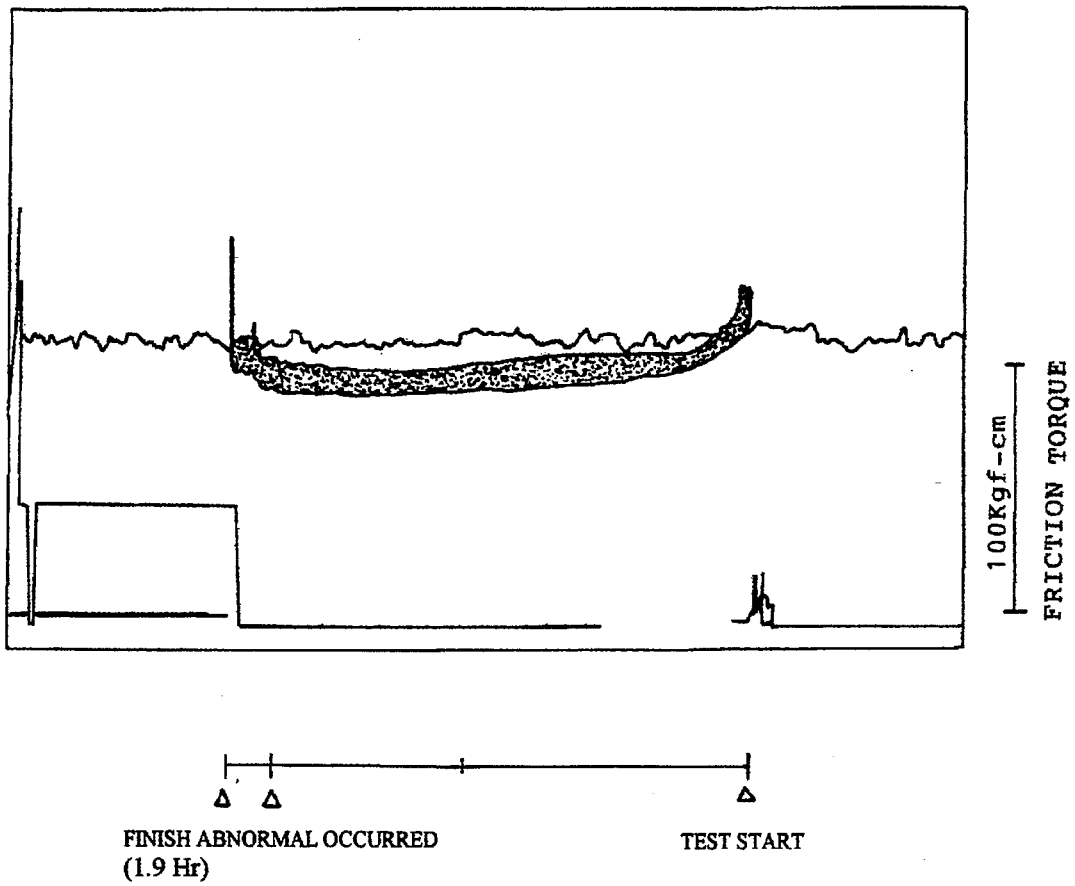
FIG. 12 is a graph showing the result of the friction and wear test in example 5.
Figure 13:
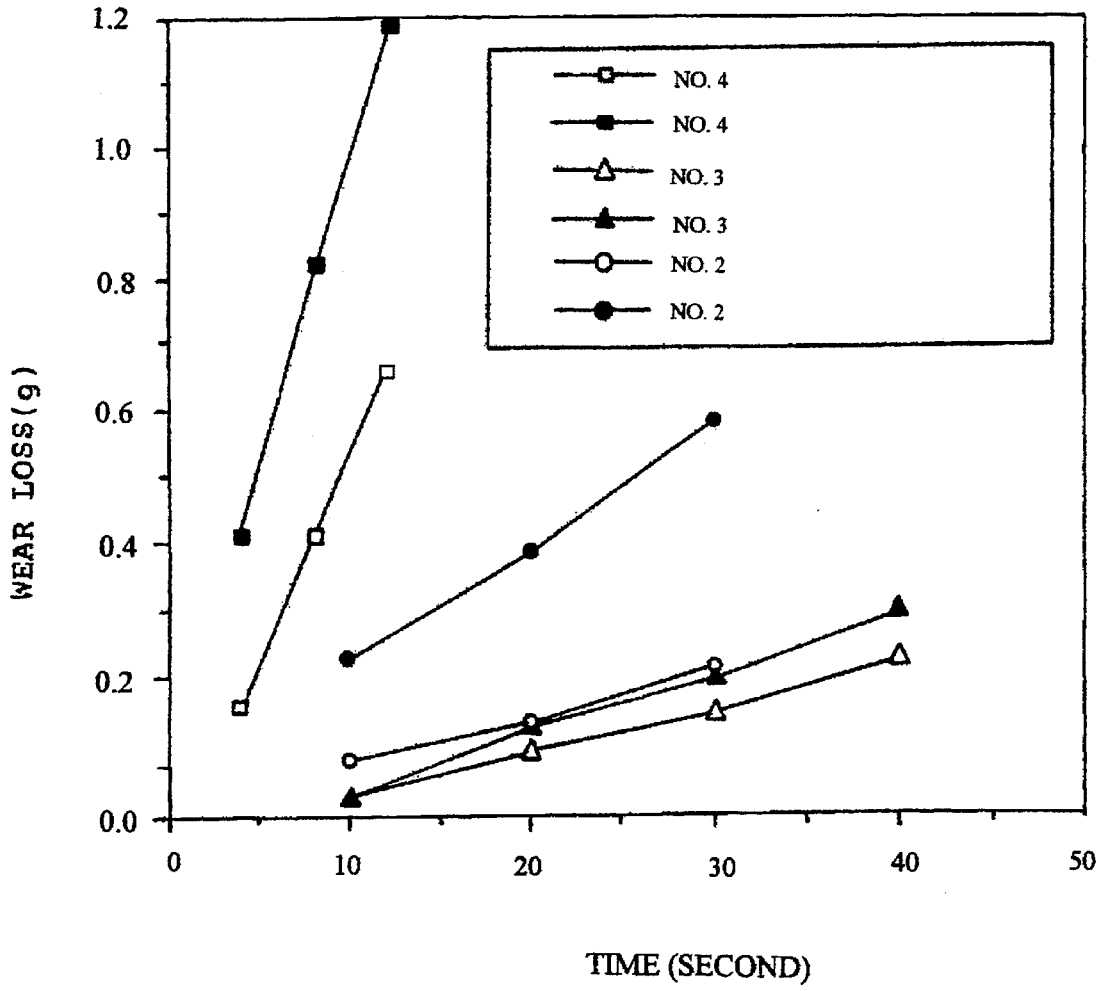
FIG. 13 is a table showing the test result of which specimen in example 5.

The test results are shown in FIG. 12 and FIG. 13. The FIG. 12 is the result of friction and wear test of No. 5 (carburized bush) specimen, and table in the Figure compares the results of No. 1 (present invention) and No. 5(carburized bush) specimens. It can be seen that the lifetime of No. 1 is more than 253 times that of No. 5, and the friction torque of No. 1 specimen is about 30% of No. 5 one.

The FIG. 13 compares the sliding wear test results of No. 2, No. 3, and No. 4 (comparative example) specimens. It can be seen that No. 2 and No. 3 specimens exhibited better wear resistances.

As can be seen in the above examples, if the material of the present invention is used for the manufacture of the bush type mechanical products such as excavator, undercarriage roller, and Idler, the motion of friction parts can be made smooth even without lubrication due to the high hardness and improved friction characteristics, and thereby reduces the maintenance cost with the Increased lifetime of the products.

What is claimed is:

1. A ferrous alloy composition comprising,

Cr: 18.0–42.0 wt %, Mn: 1.0–3.2 wt %, B: 3.0–4.5 wt %, Si: 1.0–3.0 wt %, C: less than 0.3wt %, inevitably incorporated impurities, and Fe for the rest of content.

2. The ferrous alloy composition of claim 1, further comprising P less than 0.5 wt %, or Ge and/or As less than 1.0 wt %.

3. The ferrous alloy composition of claim 1, further comprising one or more elements of Mo, Zr, Co, and Ni in the range of 0.5–1.0 wt %.

4. The ferrous alloy composition of claim 1 to claim 3 having been transformed into amorphous phase by the mechanical stresses due to friction and wear.

5. A coating method for mechanical products requiring friction and wear resistance, corrosion resistance, and heat resistance, comprising preparing ferrous alloy material defined in claim 1 in the form of powder or wire, and applying the powder or wire by thermal spraying or welding onto the mechanical product.

6. The coating method of claim 5, wherein said powder has the density of 7.3–7.4 g/cc and its particle size is less than 40 μm.

7. The coating method of claim 5, wherein the coating thickness is in the range of 20 μm –5 mm.

8. The coating method of claim 5, wherein said thermal spraying is performed by using jet gun, plasma, laser, etc.

9. The coating method of claim 5 to claim 8, wherein said mechanical products include rotation contact parts such as bush and shaft in the inside of caterpillar roller, mechanical seal under high surface pressure, and drawing dice and plug under slide friction stress.

10. A method of manufacturing mechanical products requiring friction and wear resistance, corrosion resistance, and heat resistance, the method comprising the steps of: obtaining a ferrous alloy, the ferrous alloy comprising 18.0 to 42.0 weight percent of Cr, 1.0 to 3.2 weight percent of Mn, 3.0 weight percent of B, 1.0 to 3.0 weight percent of Si, less than 0.3 weight percent of C, inevitably incorporated impurities, and Fe for the rest of content;

preparing ferrous alloy material in the form of powder or wire; and coating the ferrous alloy material in the form of powder or wire onto mechanical product.

11. The method of claim 10, wherein the coating step is performed by thermal spraying or welding.

12. The method of claim 10, wherein the ferrous alloy material is coated to a thickness in the range of 20 μm–5 mm.

13. The method of claim 10, wherein the powder has the density of 7.3 to 7.4 g/cc and particle size is less than 40 μm.

14. The method of claim 11, wherein the thermal spraying is performed by using jet gun, plasma, laser, etc.

* * * * *